US008222509B2

(12) United States Patent
Muramatsu et al.

(10) Patent No.: US 8,222,509 B2
(45) Date of Patent: Jul. 17, 2012

(54) PEDAL DEVICE OF ELECTRONIC KEYBOARD MUSICAL INSTRUMENT

(75) Inventors: Shigeru Muramatsu, Mori-machi (JP); Hisashi Takeyama, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 81 days.

(21) Appl. No.: 12/720,255

(22) Filed: Mar. 9, 2010

(65) Prior Publication Data

US 2010/0229711 A1 Sep. 16, 2010

(30) Foreign Application Priority Data

Mar. 10, 2009 (JP) ..... 2009-056347

(51) Int. Cl.
*G10C 3/12* (2006.01)

(52) U.S. Cl. ..... 84/746; 84/433; 84/439; 84/744

(58) Field of Classification Search ..... 84/746
See application file for complete search history.

(56) References Cited

U.S. PATENT DOCUMENTS

2009/0205476 A1* 8/2009 Komatsu ..... 84/17

FOREIGN PATENT DOCUMENTS

JP 2004-334008 A 11/2004

* cited by examiner

*Primary Examiner* — Elvin G Enad
*Assistant Examiner* — Christopher Uhlir
(74) *Attorney, Agent, or Firm* — Morrison & Foerster LLP

(57) ABSTRACT

A pedal device of an electronic keyboard musical instrument comprises a pedal lever swingable according to a depressing manipulation and a reaction force exerting unit for exerting on the pedal lever a reaction force of an amount which depends on an amount of the swing of the pedal lever. The reaction force exerting unit comprises, as an integral unit, a first movable member to be displaced via a thrust rod transferring the swing of the pedal lever, a first urging member which urges the first movable member in a direction to exert the reaction force on the pedal lever, a second movable member to be displaced by the first movable member after the swing of the pedal lever exceeds a predetermined amount, and a second urging member which urges the second movable member in the direction to exert the reaction force on the pedal lever. The first movable member, the second movable member, the first urging member and the second urging member are arranged coaxially around a common axis. The first movable member and the second movable member are capable of thrusting along the common axis.

4 Claims, 11 Drawing Sheets

Pedal Device Arrangement with Reaction Force Unit

Pedal Device Arrangement with Reaction Force Unit

Reaction Force Exerting Unit (Top View)

Reaction Force Exerting Unit (Side View in Section)

Reaction Force Exerting Unit (Side View in Section)

Reaction Force Exerting Unit (Side View in Section)

Reaction Force Exerting Unit (Side View in Section)

Reaction Force v. Pedal Depression

Reaction Force Exerting Unit (Side View in Section)

Reaction Force Exerting Unit (Side View in Section)

Reaction Force Exerting Unit (Side View in Section)

Reaction Force v. Pedal Depression

PEDAL DEVICE OF ELECTRONIC KEYBOARD MUSICAL INSTRUMENT

CROSS-REFERENCE TO RELATED APPLICATION

This application claims priority to Japanese Patent Application No. 2009-05634, filed Mar. 10, 2009, of which is hereby incorporated by reference in its entirety.

TECHNICAL FIELD

The present invention relates to a pedal device of an electronic keyboard musical instrument, and more particularly to a pedal device which provides an electronic keyboard musical instrument with a feeling of reaction to the pedal depression as would be experienced in the acoustic piano.

BACKGROUND INFORMATION

As is well known in the art, the acoustic piano generates or produces musical tones (sounds) with the strings struck by the associated hammers in accordance with the key strikes (depressions) by the player. Tones are generated from an acoustic piano differently in volume and resonance depending on the intensity or the speed of the key depression. An acoustic piano is equipped with pedals for controlling the sustention and the softness of the tones to be produced. A grand piano, for example, has a damper pedal, a sostenuto pedal and a shifting pedal (una corda pedal). Each of these pedals is constituted by a pedal lever which swings on (rotates around) a fulcrum or pivot provided in the bottom front area of the piano according to a depressing manipulation by the player's foot.

The damper pedal (hereinafter, simply the "pedal") among others is a pedal to control the dampers for damping the vibrations of the piano strings and is most frequently used during the piano playing. The dampers are provided in a one damper to one key correspondence (one or two or three strings per key depending on the note range), and in the regular operation stays in touch with the corresponding string or strings at its rest position where the corresponding key is not depressed, goes off from the string(s) in response to the depression of the key to allow the string(s) to vibrate being hit by the hammer, and touches on to the string(s) again in response to the release of the key to suppress the vibration of the string(s), i.e. to stop the tone generation. The dampers are linked to the pedal via several connecting members. Between the connecting members are provided some clearances to cause some dead zone or ineffective stroke range of the pedal swing. A small or shallow depression of the pedal will, accordingly, not be transferred to the dampers. However, if the pedal is depressed to a significant extent, the swing of the pedal will then be transferred to the dampers so that the dampers shall be lifted off the strings not to damp the vibrations of the strings even after the fingers are released from the keys, whereby the tones of all the depressed keys will remain sounding. In addition, all the strings in the piano including the strings which correspond to the non-depressed keys will vibrate by resonation and the harmonic partial tones for the depressed keys will be enhanced in the produced sounds. Thus, the manipulation of the damper pedal operates the dampers to give abundance of expressions to the produced piano sounds.

For example, when the pedal is slowly depressed and slowly released statically (not dynamically), the pedal receives a reaction force (a force exerted toward the direction of return to the rest position, i.e. a load felt by the player's foot) from the damper-related mechanism. More specifically, as the pedal is being depressed by the player, the depressing force will be being transferred to the dampers via the connecting members, and the reaction force to the pedal will increase accordingly due to the reactions from the elastic elements constituting the connecting members and the weights and the frictions (with the strings) of the dampers which are being partly lifted off the strings in the depression ranges A0 and A1 in FIG. 4. As the pedal is further depressed, the dampers come off the strings completely, and the increase rate of the reaction force from elastic elements included in the connecting links becomes smaller, which means that the increase rate of the reaction force against the pedal in the depression range A2 is smaller than that in the depression range A1. The range bridging the latter half of the range A1 and the beginning part of the range A2 is called a half-pedal range AH. It is known that an advanced piano player can delicately control the tone color and the resonance of the generated piano sounds by delicately vary the depression amount of the pedal in the half-pedal range AH. Depending on the manufacturers and the models of acoustic pianos, the structures of the damper-related mechanisms including the pedal, the connecting members and the dampers may be different, which in turn may cause differences in the widths of the range A0, A1, AH and A2 and the positions of the boundaries between the adjacent ranges. Further, the increase rates of the reaction force in the ranges A0 and A1 may also be different as seen in FIG. 8.

An example of a pedal device to simulate the above-mentioned operational feeling of an acoustic piano in an electronic keyboard musical instrument is shown in unexamined Japanese patent publication No. 2004-334008. The illustrated pedal device of an electronic keyboard musical instrument comprises two swingable levers provided in a vertically spaced-apart and vertically pushing relation, two springs, each provided between one of the levers and a fixed member for urging the lever toward its rest position. As the front end of the lower lever (i.e. the pedal lever) is depressed by a foot and the rear end swings upward by a predetermined amount, the rear end touches the upper lever, and when the upper lever is pushed up by a certain amount, it drives the next members constituting the damper-related mechanism. Within the range where only the lower lever swings, the lower lever receives a reaction force from the spring urging the lower lever. As the lower lever (pedal lever) is further depressed to swing further to push up the upper lever, the lower lever receives a reaction force from the spring urging the upper lever in addition to the reaction force from the spring urging the lower lever. Thus, the rate of increase of the reaction force exerted on the pedal (i.e. lower) lever will be varied stepwise in accordance with the amount of depression of the pedal lever.

However, according to the idea of the above-mentioned prior art pedal device of an electronic keyboard musical instrument, all the movable members driven by the pedal manipulation are levers. So, if the stepwise variation of the friction force is to be increased and the number of levers is to be increased, the size of the pedal device will be increased accordingly, and problems will arise with the space for accommodation, the cost of manufacture, the design of the device, etc. Further, in the above-mentioned prior art pedal device of an electronic keyboard musical instrument, the curve of the pedal depression and reaction force characteristic is a simple superposition of linear functions according to the combination of the springs, which cannot realize a reaction force characteristic exhibiting a smaller rate of increase on the middle way of depression. Thus, the prior art pedal device for an electronic keyboard musical instrument cannot exactly simulate the reaction force characteristic of an acoustic piano.

SUMMARY OF THE INVENTION

In view of the foregoing circumstances, therefore, it is a primary object of the present invention to provide a pedal device of an electronic keyboard musical instrument which can be designed in a compact size and manufactured at low cost.

According to the present invention, the object is accomplished by providing a pedal device of an electronic keyboard musical instrument, which comprises: a pedal lever swingable on a fulcrum within a stroke range between an initial position and an end position according to a depressing manipulation by a player of the instrument; and a reaction force exerting unit for exerting on the pedal lever a reaction force of an amount which depends on an amount of the swing of the pedal lever, wherein the reaction force exerting unit comprises, as an integral unit, a first movable member to be displaced according to the swing of the pedal lever as the swing of the pedal lever is transferred from the pedal lever to the first movable member directly or by means of a transferring member, a first urging member which urges the first movable member in a direction to exert the reaction force on the pedal lever, a second movable member to be displaced according to the displacement of the first movable member after the amount of the swing of the pedal lever exceeds a predetermined amount, and a second urging member which urges the second movable member in the direction to exert the reaction force on the pedal lever, wherein the first movable member, the second movable member, the first urging member and the second urging member are arranged coaxially with each other with respect to a common axis in a manner in which the first movable member and the second movable member are capable of thrusting along the common axis. Thus, the pedal device for an electronic keyboard musical instrument can be designed in a compact size and manufactured at low cost, as the first movable member, the second movable member, the first urging member and the second urging member are arranged coaxially with each other with respect to a common axis in a manner in which the first movable member and the second movable member are capable of thrusting along the common axis. Further, by assembling the first movable member, the second movable member, the first urging member and the second urging member in the form of an integral unit, the manufactured pedal device will be very conveniently handled and installed in an electronic keyboard musical instrument.

In an aspect of the present invention, the first movable member, the second movable member, the first urging member and the second urging member may be arranged relative to each other such that the reaction force exerted on the pedal lever increases in accordance with the amount of the swing of the pedal lever at a first rate of increase of the reaction force per amount of the swing in a first stroke range of the swing in which only the first movable member is being displaced in response to the swing of the pedal lever, while the reaction force exerted on the pedal lever increases in accordance with the amount of the swing of the pedal lever at a second rate of increase of the reaction force per amount of the swing in a second stroke range of the swing in which both of the first movable member and the second movable member are being displaced in response to the swing of the pedal lever, wherein the second rate of increase at a part of the second stroke range contiguous to the first stroke range is smaller than the first rate of increase in the first stroke range. Thus, the pedal device will assume the reaction force characteristic delicately similar to that of an acoustic piano.

In another aspect of the present invention, the first urging member and/or the second urging member may be constituted by a plurality of urging members, two of the plurality of urging members being arranged such that one of the two is positioned inside the other of the two overlapping each other at a same axial position. By arranging two urging members coaxially overlapping each other with the one inside the other, the axial length of the reaction force exerting unit can be minimized, which will contribute to designing in a compact size.

In a further aspect of the present invention, the pedal device may further comprise a friction mechanism integrally arranged with the reaction force exerting unit to cause a friction force resisting the displacement of the first movable member according to the swing of the pedal lever. The friction mechanism will serve to more closely simulate the reaction force characteristic of a pedal mechanism in an acoustic piano. In addition, by arranging the friction mechanism integrally with the reaction force exerting unit, the manufactured pedal device will be more conveniently handled and assembled than in the case where the friction mechanism and the reaction force exerting unit are provided separately.

In a still further aspect of the present invention, the pedal device may further comprise a detecting mechanism integrally arranged with the reaction force exerting unit to detect the movement of the first movable member according to the swing of the pedal lever throughout the stroke range of the swing from the initial position to the end position. By arranging the detecting mechanism integrally with the reaction force exerting unit, the manufactured pedal device can be more conveniently handled, assembled, inspected and installed in an electronic keyboard musical instrument than in the case where the detecting mechanism and the reaction force exerting unit are provided separately.

The invention and its various embodiments can now be better understood by turning to the following detailed description of the preferred embodiments which are presented as illustrated examples of the invention defined in the claims. It is expressly understood that the invention as is defined by the claims may be broader than the illustrated embodiments described bellow.

BRIEF DESCRIPTION OF THE DRAWINGS

For a better understanding of the present invention, and to show how the same may be practiced and will work, reference will now be made, by way of example, to the accompanying drawings, in which.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

Embodiment 1

Figure 1:
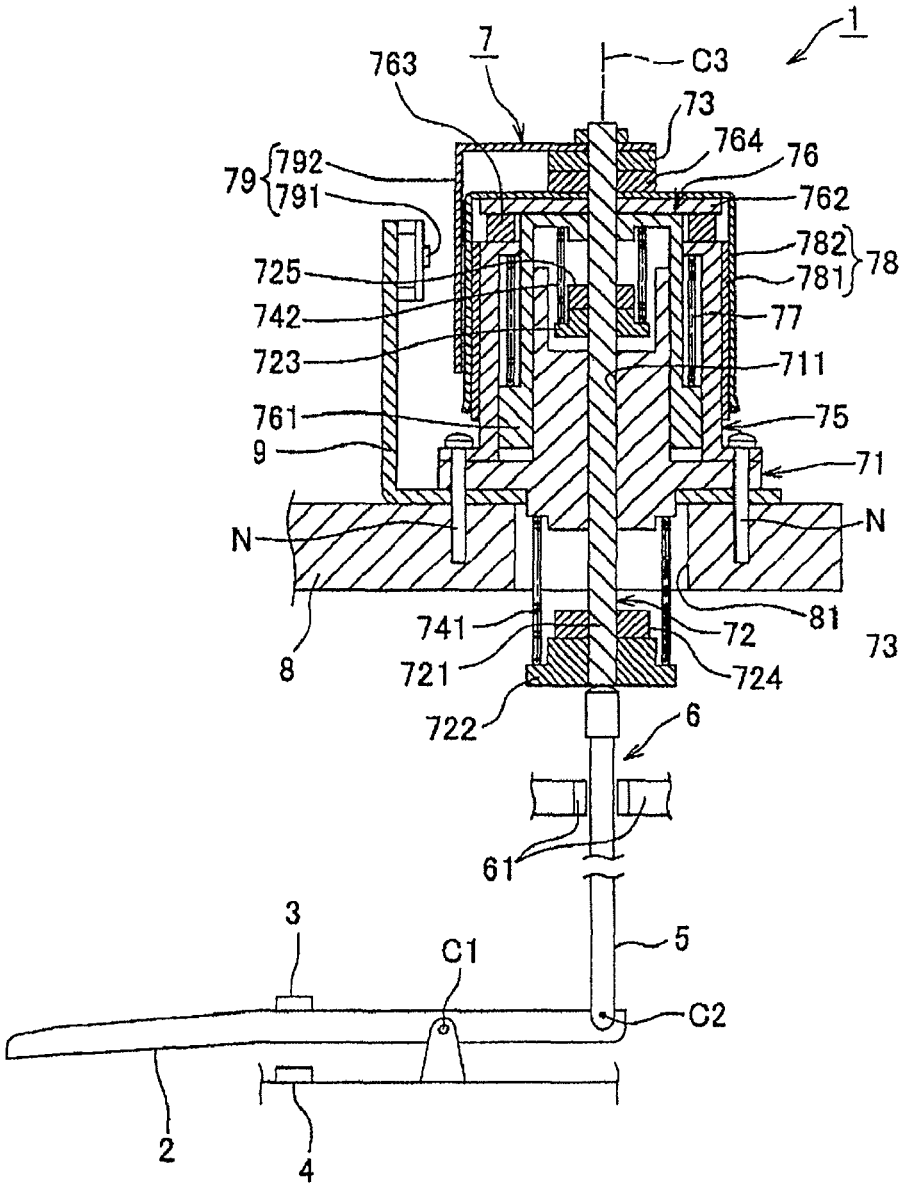
FIG. 1 is a sectional side view of a pedal device of an electronic keyboard musical instrument according to a first embodiment of the present invention.

FIGS. 1-4 show a first embodiment of a pedal device of an electronic keyboard musical instrument according to the present invention. In the following description, the terms "up/down, left/right and front/rear" of the electronic keyboard musical instrument mean the directions of "up/down, left/right and front/rear" of the instrument in its upstanding position as viewed from the instrument player when playing the instrument. As shown in FIG. 1, which is a sectional side view of a pedal device of an electronic keyboard musical instrument according to a first embodiment of the present invention, the pedal device 1 comprises a pedal lever 2, an upper limit stopper 3, a lower limit stopper 4, a thrust rod 5, a first friction mechanism and a reaction force exerting unit 7. The pedal lever 2 is provided in the form of an elongated shape extending in the front-to-rear direction and supported by a fulcrum C1 to be swingable around the pivot of the fulcrum C1. As the front end of the pedal lever 2 is depressed by the instrument player, the pedal lever 2 swings on the fulcrum C1 within the range from the rest position (i.e. the initial position) to the stop-depression position (i.e. the lower end of the regular stroke). The upper limit stopper 3 and the lower limit stopper 4 is made of felt or rubber or the like material. The upper limit stopper 3 is a stopper that abuts the pedal lever 2 when the pedal lever 2 is at its rest (initial) position to limit the upward swing of the front part of the pedal lever 2. The lower limit stopper 4 is a stopper that abuts the pedal lever 2 when the pedal lever 2 is at its stop-depression (lower stroke end) position to limit the downward swing of the front part of the pedal lever 2.

The thrust rod 5 is provided in the form of a rod shape extending in the vertical direction, and is capable of thrusting in the up/down direction. The lower end of the thrust rod 5 is arranged to abut the rear end of the pedal lever 2 at a point C2 in FIG. 1. The upper end of the thrust rod 5 is arranged to abut the lower end of a first movable member 72 (to be described herein later) comprised in the reaction force exerting unit 7. When the pedal lever 2 is depressed, the thrust rod 5 is pushed upward, which in turn pushes up the first movable member 72. Thus, the thrust rod 5 constitutes a transfer member that transfers the swing of the pedal lever 2 to the first movable member 72. The first friction mechanism 6 comprises a friction causing member 61 which is made of artificial leather or felt and produces friction against the movement of the thrust rod 5 as the thrust rod 5 touches the member 61.*e* The friction causing member 61 is fixed so that the thrust rod 5 slides therethrough. As the thrust rod 5 thrusts upward and downward in accordance with the depressing manipulation on to the pedal lever 2, the trust rod 5 rubs the friction causing member 62 to produce friction therebetween. By providing the first friction mechanism 6 associated with the thrust rod 5, the pedal lever 2 receives a reaction force according to the friction within the entire stroke range of the depression of the pedal lever 2 from the rest (initial) position to the stop-depression (stroke end) position.

Figure 2A:
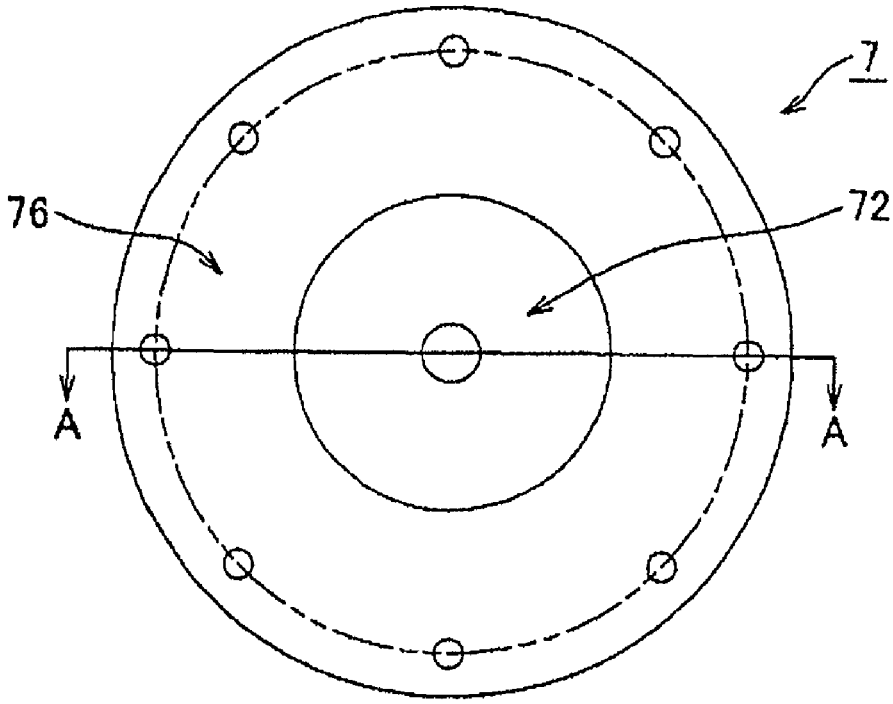
FIG. 2*a* is a top view of a reaction force exerting unit included in the pedal device of FIG. 1.
Figure 2B:
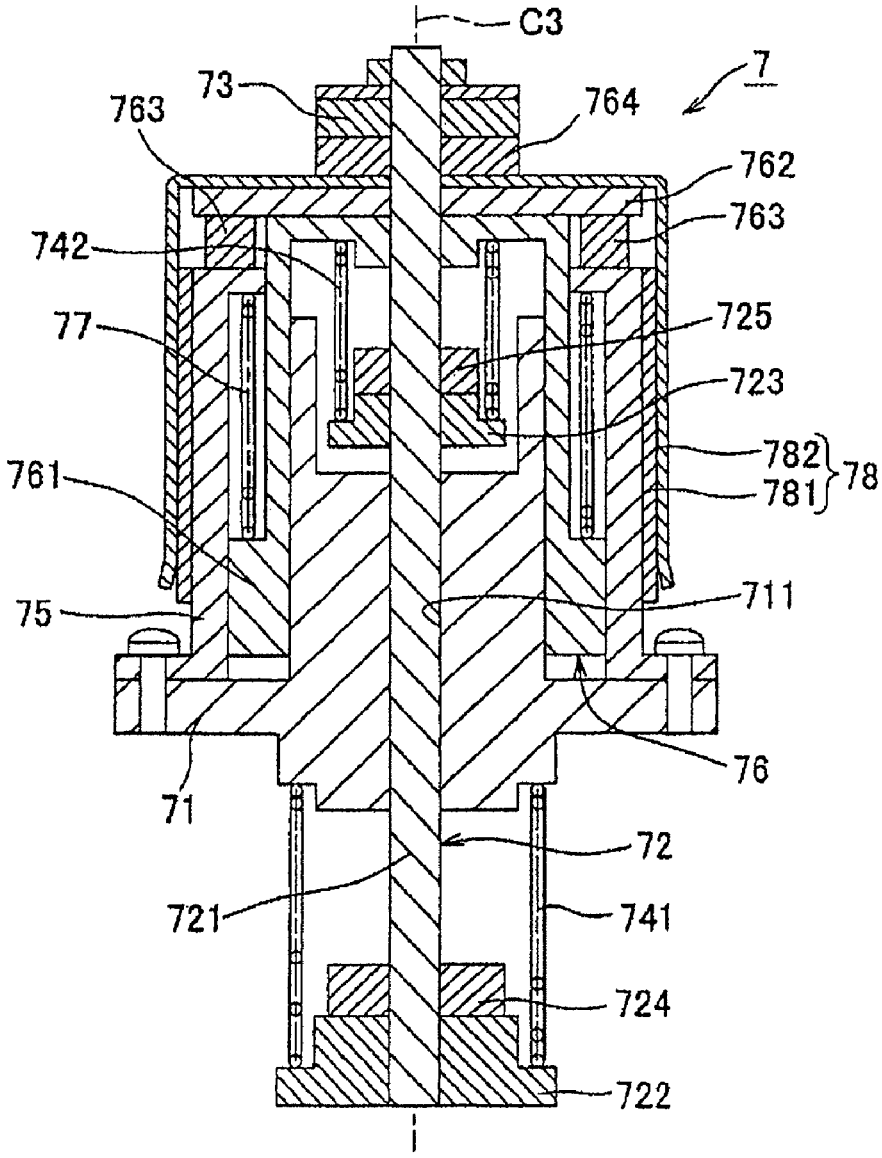
FIG. 2*b* is a sectional side view taken along the arrowed line A-A of FIG. 2*a;*

As shown in FIGS. 1 and 2*b*, the reaction force exerting unit 7 comprises as an integral unit a first fixed member 71, a first movable member 72, a weight member 73, a first urging member 74 including an lower and upper first springs 741 and 742, a second fixed member 75, a second movable member 76 and a second urging member (spring) 77. As shown in FIG. 1, the first fixed member 71 is integrally assembled with the second fixed member 75, the first movable member 72, a second movable member 76, the first springs 741 and 742, the second spring 77, a detecting mechanism 79, etc. to constitute the reaction force exerting unit 7, and is mounted on a bed board 8 by means of screws N. The first fixed member 71 is shaped, for example, in the form of a cylinder and is provided with an axial bore 711 penetrating therethrough along its central axis C3, and a first movable member body 721 (to be described herein later) is inserted in the axial bore 711.

The first movable member 72 is comprised of the first movable member body 721 and first movable member flange pieces 722 and 723. The first movable member body 721 is formed in a rod shape with its longitudinal axis lying in the vertical direction along the central axis C3, and is supported to be capable of thrusting vertically within the depression stroke range of the pedal lever 2 between the initial position and the end position. The first movable member body 71 is inserted through the axial bore 711 with its lower end portion protruding downward through an aperture 81 in the bed board 8 (FIG. 1). The flange piece 722 is fixedly provided at the lower end of the first movable member body 721 and receives the lower end of the lower first spring 741 whose upper end is pushing the lower end of the first fixed member 71. On the upper surface of the flange piece 722 is provided a stopper piece 724 made of felt, rubber or the like material. The stopper piece 724 is to abut the lower surface of the first fixed member 71 when the first movable member 72 is pushed up to the stroke end of the depression of the pedal lever 2, thereby limiting the thrusting movement of the first movable member 72. On the other hand, the flange piece 723 is fixedly provided on to the first movable member body 721 at a position below an inverted cup-shaped ceiling of the second movable member 76 and receives the lower end of the upper first spring 742 whose upper end is pushing the lower surface of the ceiling of the inverted cup-shaped second movable member 76. On the upper surface of the flange piece 723 is provided a stopper piece 725 made of felt, rubber or the like material. The stopper piece 725 is to abut the lower surface of the ceiling of the second movable member 76 when the first movable member 72 is pushed up to a predetermined position in the depression stroke of the pedal lever 2.

The weight member 73 is fixedly provided near the upper end of the first movable member body 721 and is exerting a gravitational force onto the pedal lever 2 via the first movable member body 721 and the thrust rod 5. The lower and upper first springs 741 and 742 constitute a first urging member 74 to urge the first movable member 72 toward the direction of exerting the reaction force onto the pedal lever 2. The lower first spring 741 is provided between the first fixed member 71 and the flange piece 722 of the first movable member 72. Namely, the lower first spring 741 is supported between the first fixed member 71 and the flange piece 722 of the first movable member 72 with the lower end of the spring 741 abutting the fixed member 71 and the upper end of the spring 741 abutting the flange piece 722. The upper first spring 742 is provided between the flange piece 723 of the first movable member 72 and the second movable member 76. Namely, the upper first spring 742 is supported between the flange piece 723 of the first movable member 72 and the second movable member 76 with the lower end of the spring 742 abutting the flange piece 723 and the upper end of the spring 742 abutting the second movable member 76. The second fixed member 75 is also integrally assembled with the other members or elements in the reaction force exerting unit 7, and is mounted on the bed board 8 by means of screws N. The second fixed member 75 is formed in a cylindrical shape, and accommodates therein the first fixed member 71, a first movable member 72 and the second movable member 76 as will be described in more detail herein later. The second movable member 76 is comprised of a second movable member body 761 and a disk portion 762. The second movable member body 761 is formed in the shape of an inverted cup opening downward. The lower end portion of the second movable member body 761 is formed with a flange-shaped shoulder so that the second spring 77 is compressed between the shoulder and an upper inward flange of the second fixed member 75. The second movable member body 761 is capable of thrusting vertically.

The disk portion 762 is fixedly provided on the top of the second movable member body 761. Under the periphery of the disk portion 762, a stopper piece 763 made of felt, rubber or the like material is provided on the upper surface of the upper inward flange of the second fixed member 75. The stopper piece 763 abuts the lower surface of the disk portion 762 of the second movable member 76 to define the initial (lowest) position of the second movable member 76 in its thrusting movement. Further, on the upper surface of the disk portion 762 is provided a stopper piece 764, which abuts the lower surface of the weight member 73 to limit the downward thrusting movement of the first movable member 72 when the first movable member 72 is in its initial position. The second spring 77 is supported between the second fixed member 75 and the second movable member 76, with the upper end of the second spring 77 abutting the lower surface of the upper inward flange of the second fixed member 75 and with the lower end of the second spring 77 abutting the upper surface of the lower outward flange of the second movable member body 761. The second spring 77 is arranged in a compressed state between the second fixed member 75 and the second movable member 76 when the second movable member 76 is in its initial position of the thrusting movement.

The description will be now turned to the details of the arrangement of the first movable member 72, the second movable member 76, the lower and upper first springs 741 and 742, and the second spring 77. The first movable member 72, the second movable member 76, the lower and upper first springs 741 and 742, and the second spring 77 are arranged coaxially with each other with respect to the common axis C3. The first movable member 72 and the second movable member 76 are movable in a thrust direction along the common axis C3. The first movable member 72 locates inside the first springs 741, 742, while the second movable member 76 locates inside the second spring 77. In addition, the first movable member 72 locates inside the second movable member 76 so that the first movable member 72 and the second movable member 76 are positioned to overlap with each other at a same axial position relative to the common axis C3. And further, the upper first spring 742 locates inside the second spring 77 so that the upper first spring 742 and the second spring 77 are positioned to overlap with each other at a same axial position relative to the common axis C3.

The reaction force exerting unit 7 comprises a second friction mechanism 78 and a displacement detecting mechanism 79, which are all assembled in an integral unit. The second friction mechanism 78 is comprised of a friction causing member 781 made of artificial leather or felt or the like material which causes friction when rubbed by other members and of a sliding member 782 to rub the friction causing member 781. The friction causing member 781 is fixed on the outer wall of the second fixed member 75, while the sliding member 782 (of an inverted cup shape) is fixed to the second movable member 76 (i.e. to the disk portion 762) in an arrangement in which the sliding member 782 rubs the friction causing member 781. Thus, when the second movable member 76 moves (thrusts) vertically, the friction causing member 781 and the sliding member 782 rubs each other causing friction therebetween. The sliding member 782 is urged toward the friction causing member 781. The urging force will also prevent the sliding member 782 from shaking which might otherwise occur as the sliding member 782 rubs the friction causing member 781 an accordance with the thrust movement of the second movable member 76. The displacement detecting mechanism 79 is comprised of a light sensor 791 and a scale plate 792 carrying a displacement representing member such as a gray scale of which the light sensor 791 can detect the displacement. The light sensor 791 is fixed to the fixed supporting member 9 which in turn is fixed to the bed board 8 by means of the screws N together with other members to be assembled in the reaction force exerting unit 7 as an integral unit as shown in FIG. 1. The scale plate 792 is fixed to the first movable member 72 as shown in FIG. 1.

Description will now be made, with reference to FIGS. 3*a*, 3*b*, 3*c* and 4, as to how the above-described first embodiment of the pedal device 1 operates when the pedal lever is depressed by the instrument player. First, in the initial state shown in FIG. 3*a* where the pedal lever is not depressed by the player, the first movable member 72 is at its lowermost position with the weight member 73 abutting against the stopper 764, being urged downward by the weight of the weight member 73 and the urging forces of the first springs 741, 742 and the second spring 77. It should be understood that, in the initial state shown in FIG. 3*a*, the force of the upper first spring 742 urging the second movable member 76 upward is smaller than the force exerted downward on the second movable member 76. The downward resultant force exerted on the second movable member 76 is the sum of the gravity caused by the weight of the second movable member 72, the friction force caused by the second friction mechanism 78 and the downward urging force caused by the second spring 77. Accordingly, the second movable member 76 is kept in its lowermost position with the disk portion 762 abutting the stopper piece 763. Under these circumstances, the pedal lever 2 is kept at its initial position. As the player depresses the front end of the pedal lever 2 during the playing manipulation, the pedal lever 2 swings on the fulcrum C1. The swing of the pedal lever 2 is transferred to the first movable member 72 via the thrust rod 5, and the first movable member 72 moves upward. During the beginning period of the first movable member 72 traveling upward, the force of the upper first spring 742 urging the second movable member 76 upward is still smaller than the resultant force exerted on the second movable member 76, and the second movable member 76 stays at its initial position. As the first movable member 72 is pushed up further, the lower and upper first springs 741, 742 are compressed further so that the compression force increases accordingly. Thus the reaction force exerted on the pedal lever 2 will increase at a rate of increase determined by the spring moduli of the first springs 741, 742 in accordance with the amount of the pedal depression by the player as indicated in the range A01 of the graph of FIG. 4.

Thereafter, when the amount of pedal depression reaches a predetermined amount, the upward elastic force (compressive force) by the upper first spring 742 against the second movable member 76 grows equal to the downward opposing force exerted on the second movable member 76. As the pedal lever 2 is further depressed, the upward elastic force will grow greater than the downward opposing force, and the second movable member 76 will then move upward pushed up by the first movable member 72 via the upper first spring 742 serving as a force transferring member. In the embodiment shown in FIG. 3*b*, however, the stopper piece 725 provided on the first movable member 72 is designed to abut against the second movable member 76 when the upward elastic force has grown equal to the downward opposing force exerted on the second movable member 76. Thus in this embodiment, the displacement of the first movable member 72 is also transferred to the second movable member 76 directly via the stopper 725. As the first movable member 72 and the second movable member 76 are further pushed up in accordance with the pedal lever depression, the lower first spring 741 and the second spring 77 will be compressed further, with the upper first spring 742 being no longer compressed. Thus the reaction force exerted on the pedal lever 2 increases at a rate determined by the spring moduli of the lower first spring 741 and the second spring 77 in accordance with the amount of the pedal depression by the player as indicated in the range A2 of the graph of FIG. 4, the upper first spring 742 no longer contributing to the increase of the reaction force, as the upper first spring 742 is not compressed any more as described above. In the present embodiment, the rate of increase of the reaction force in the range A2 is made smaller than the rate of increase of the reaction force in the range A01 by, for example, setting the spring modulus of the second spring 77 smaller than the spring modulus of the upper first spring 742. Further, by arranging the stopper piece 725 to abut against the second movable member 76 when the upward elastic force by the upper first spring 742 becomes equal to the downward resultant force exerted on the second movable member 76 as mentioned above, a smooth continuation of the reaction characteristic curve is realized at the border between the range A1 and the range A2 (to be described later) as shown by a solid curve line in FIG. 4.

Figure 3A:
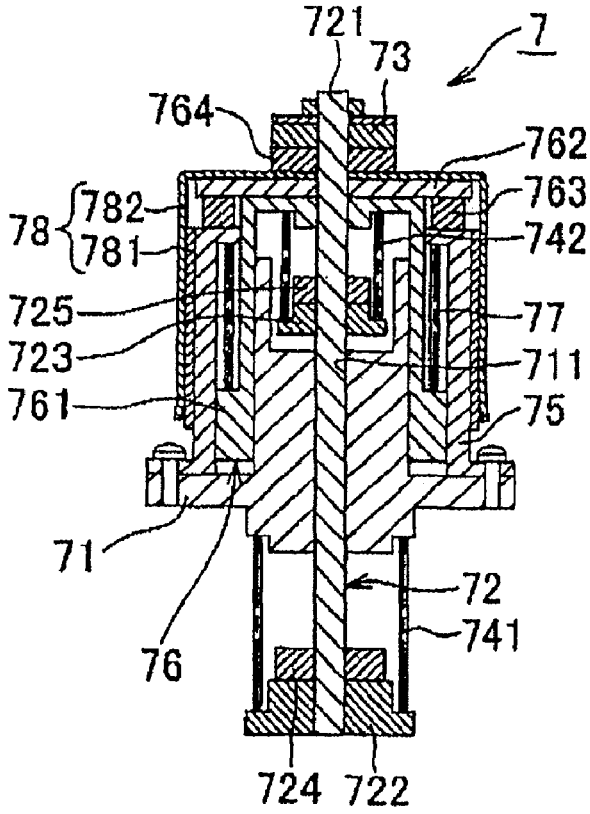
FIG. 3*a* is a sectional side view of the reaction force exerting unit showing a state during the operation thereof.
Figure 3B:
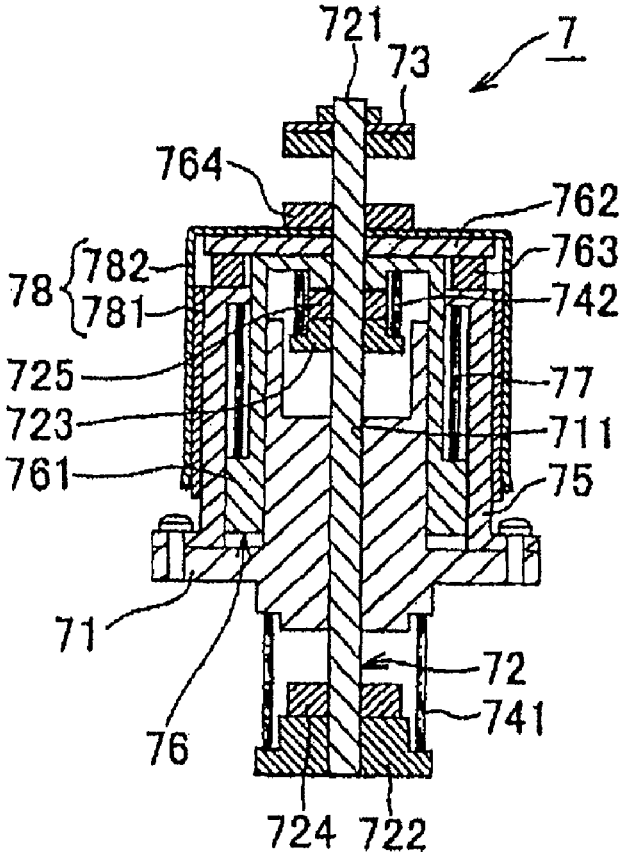
FIG. 3*b* is a sectional side view of the reaction force exerting unit showing another state during the operation thereof.
Figure 3C:
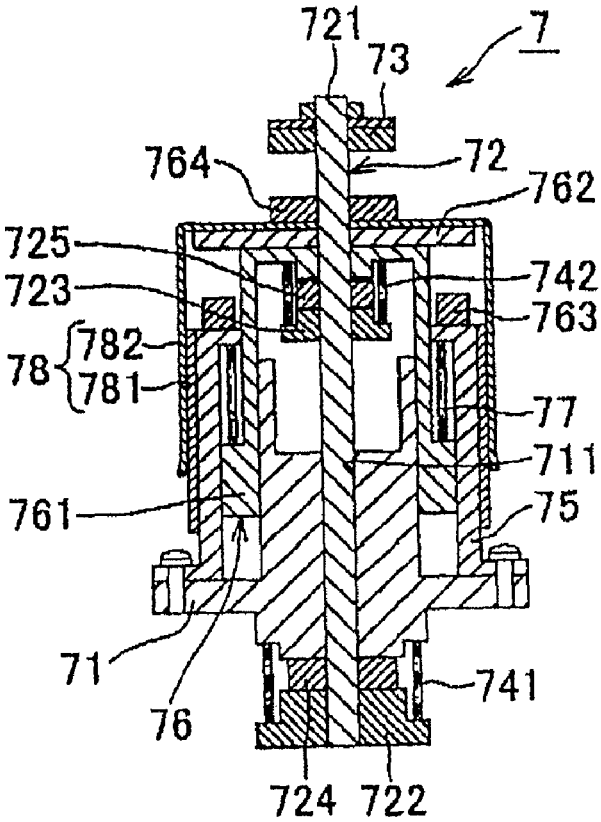
FIG. 3*c* is a sectional side view of the reaction force exerting unit showing a further state during the operation thereof.
Figure 4:
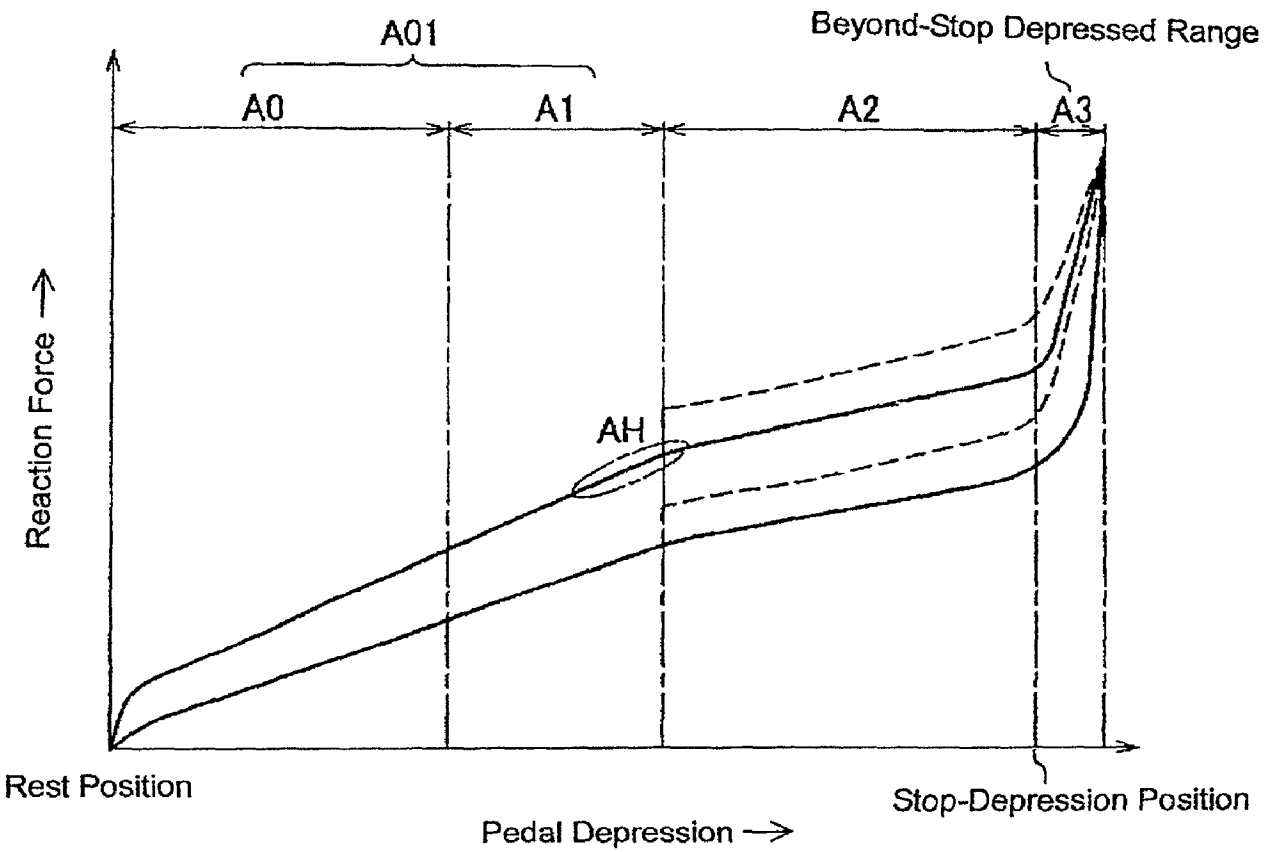
FIG. 4 is a graphical representation of the reaction force exerted on the pedal by the reaction force exerting unit shown in FIG. 1 as a function of the amount of the depression of the pedal lever.

As the player depresses the pedal lever 2 further, the pedal lever 2 abuts against the lower limit stopper 4 and the stopper piece 724 fixed to the first movable member 72 abuts against the first fixed member 71 (as shown in FIG. 3*c*) almost at the same time, and the pedal lever 2 stays at its stroke-end position (stop-depression position). If the player forcibly depresses the pedal lever 2 still further, the lower limit stopper 4 and the stopper piece 724 are deformed elastically, and the reaction force exerted on the pedal lever 2 increases rapidly at a higher increase rate according to the excess depression by the player as seen in a beyond-stop depression range A3 in FIG. 4. To summarize the above described operation process, the lower first spring contributes to the increase rate of the reaction force exerted on the pedal lever in all of the ranges A01, A2 and A3, wherein the range A01 is where only the first movable member 72 travels, the range A2 is where both the first movable member 72 and the second movable member 76 travels, and the range A3 is where the first movable member 72 is forcibly and slightly displaced beyond the stroke-end position. The upper first spring 742 contributes to the increase rate of the reaction force exerted on the pedal lever 2 only in the above-mentioned range A01. The second spring 77 contributes to the increase rate of the reaction force exerted on the pedal lever 2 in both of the ranges A2 and A3. The lower first spring 741 contributes to the increase rate of the reaction force exerted on the pedal lever 2 in all of the depression ranges, which gives an effect of stabilizing the manipulability of the pedal lever 2.

According to the first embodiment as described above, the first movable member 72, the second movable member 76, the lower and upper first springs 741, 742 and the second spring 77 are arranged coaxially with each other with respect to the common axis C3 in a configuration that the first movable member 72 and the second movable member 76 are capable of thrusting along the common axis C3, which configuration is beneficial in miniaturizing and cost-cutting the reaction force exerting unit 7. The structure of configuring the first movable member 72, the second movable member 76, the lower and upper first springs 741, 742 and the second spring 77 in an integral unit is advantageous in handling and installing in an electronic keyboard musical instrument.

Further, according to the first embodiment as described above, the lower and upper first springs 741, 742 and the second spring 77 is so designed and arranged that the increase rate of the reaction force exerted on the pedal lever 2 in the depression range A01 where only the first movable member 72 is displaced is greater than the increase rate of the reaction force exerted on the pedal lever 2 in the depression range A2 where both the first movable member 72 and the second movable member 76 are displaced. This arrangement can realistically simulate the reaction force characteristic of the pedal in the acoustic piano.

Still further, according to the first embodiment as described above, the upper first spring 742 and the second spring 77 are arranged coaxially such that the upper first spring 742 is positioned inside the second spring 77 overlapping each other at a same axial position with respect to the common axis C3. This arrangement is advantageous in minimizing the axial length of the reaction force exerting unit 7, which facilitates miniaturization of the unit 7.

Incidentally, the elements which cause the reaction force (F) against the pedal being depressed in the acoustic piano are the following four terms: the inertia term, the flow resistance term, the spring resistance term and the friction resistance term. In this connection, the equation of motion is expresses as follows:

$$F=m(d2x/dt2)+\rho(dx/dt)+kx+\mu N \quad \text{(Eq. 1)}$$

wherein "m" represents the mass as the coefficient of the inertia term, "ρ" the viscosity as the coefficient of the flow resistance term, "k" the stiffness (spring modulus) as the coefficient of the spring resistance term, and "μ" the coefficient of friction.

Among these four terms, the flow resistance term is known to be negligibly small in view of its effect. Consequently, the above-described first embodiment comprising the first friction mechanism 6 and the second friction mechanism 78 produces the reaction force according to the friction, and therefore can simulate the reaction force characteristic of the pedal depression in the acoustic piano all the more exactly. Further, as the second friction mechanism 78 is provided integrally with the friction force exerting unit 7, the reaction force exerting unit 7 is more convenient in handling and installing in an electronic keyboard musical instrument than in the case where the second friction mechanism 78 is provided separately from the reaction force exerting unit 7.

Further, according to the first embodiment, as the displacement detecting mechanism 79 is provided integrally with the reaction force exerting unit 7 the reaction force exerting unit 7 is all the more convenient in handling and installing in an electronic keyboard musical instrument than in the case where the displacement detecting mechanism 79 is provided separately from the reaction force exerting unit 7.

Although, in the above-described first embodiment, the stopper piece 725 abuts against the second movable member 76, when the elastic force of the upper first spring 742 grows equal to the downward force exerted on the second movable member 76, the present invention is not necessarily limited to such an arrangement. For example, the reaction force exerting unit 7 may be so designed that the stopper piece 725 abuts against the second movable member 76 before the elastic force of the upper first spring 742 has grown equal to the downward force exerted on the second movable member 76. With such an arrangement, the reaction force characteristic will assume a characteristic curve having a stepwise discontinuity between the depression range A1 and the depression range A2 as shown by the broken line in FIG. 4.

Embodiment 2

Figure 5:
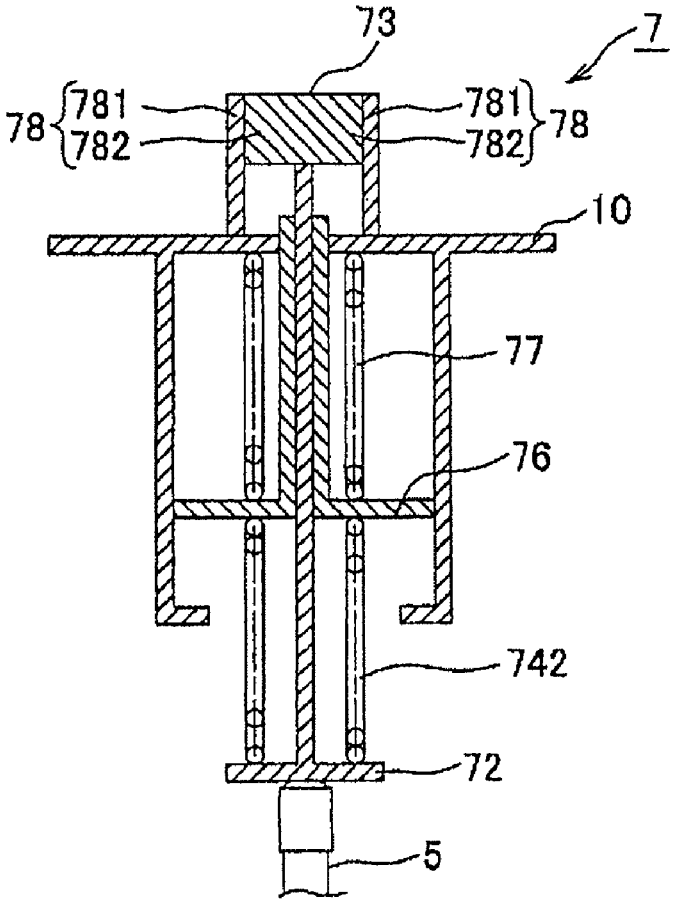
FIG. 5 is a sectional side view, somewhat schematically depicted, of a reaction force exerting unit according to a second embodiment of the present invention.
Figure 6:
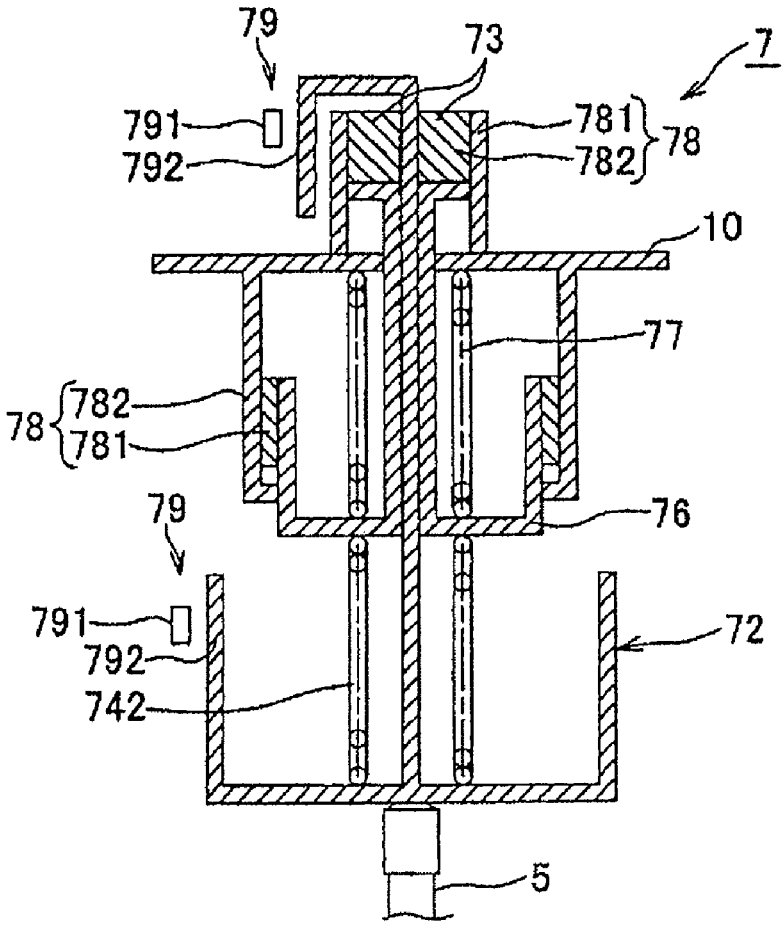
FIG. 6 is a sectional side view, schematically depicted as FIG. 5, of a reaction force exerting unit according to a modified second embodiment of the present invention.

Referring now to FIGS. 5 and 6, a description will be made about a second embodiment of a pedal device of an electronic keyboard musical instrument according to the present invention. It should be understood that FIGS. 5 and 6 each depict a reaction force exerting unit 7 included in the pedal device 1 somewhat schematically with some of the elements, for example, the stoppers omitted. In FIGS. 5 and 6, like parts as those in the pedal device 1 of the first embodiment shown in FIG. 1 are given like references to indicate the correspondencies and detailed description of some of them will be omitted for the sake of simplicity. Reference numeral 10 indicates a fixed member in the reaction force exerting unit 7 of the second embodiment. While the above-described embodiment 1 employs two first springs 741 (lower one) and 742 (upper one) as the first urging member 74 for urging the first movable member 72, the first urging member 74 may consist of one first spring 742 provided between the first movable member 72 and the second movable member 76 as in the second embodiment shown in FIGS. 5 and 6. In this case also, the first spring 742 contributes to the increase rate of the reaction force exerted on the pedal lever 2 only within the range A01 of FIG. 4. The second spring 77 contributes to the increase rate of the reaction force exerted on the pedal lever 2 both in the ranges A2 and A3.

Further, while the above-described embodiment 1 employs the weight member 73 provided on the first movable member 72, the weight member 73 may be provided on the second movable member 76 as in the modified second embodiment shown in FIG. 6. Further, in the first embodiment, the second friction mechanism 78 comprises the friction causing member 781 provided on the second fixed member 75 and the sliding member 782 provided on the second movable member 72. However, the present invention may not necessarily be limited to such a configuration. The friction causing member 781 may be fixed to the fixed member 10 and the sliding member 782 may be the side wall itself of the weight member 73 fixed to the first movable member 72 as in the second embodiment shown in FIG. 5. Or otherwise, the friction causing member 781 may be fixed to the outer side wall of the second movable member 76 and the sliding member 782 may be the inner side wall of the fixed member 10. In short, either one of the friction causing member 781 and the sliding member 782 to constitute the friction mechanism 78 may be fixed to the first movable member 72 or the second movable member 76, and the other one may be fixed to the fixed member 10.

Further in the above-described first embodiment, the scale plate 792 of the displacement detecting mechanism 79 is provided on the upper part of the first movable member 72 and the light sensor 791 is fixed to the fixed supporting member 9 so that the light sensor 791 can read the displacement of the scale plate 792. The present invention may not necessarily be limited to such a configuration. The scale plate 792 has only to be fixed to the first movable member 72, and can be provided, for example, on the lower part of the first movable member 72 as in the modified second embodiment shown in FIG. 6.

Embodiment 3

Figure 7:
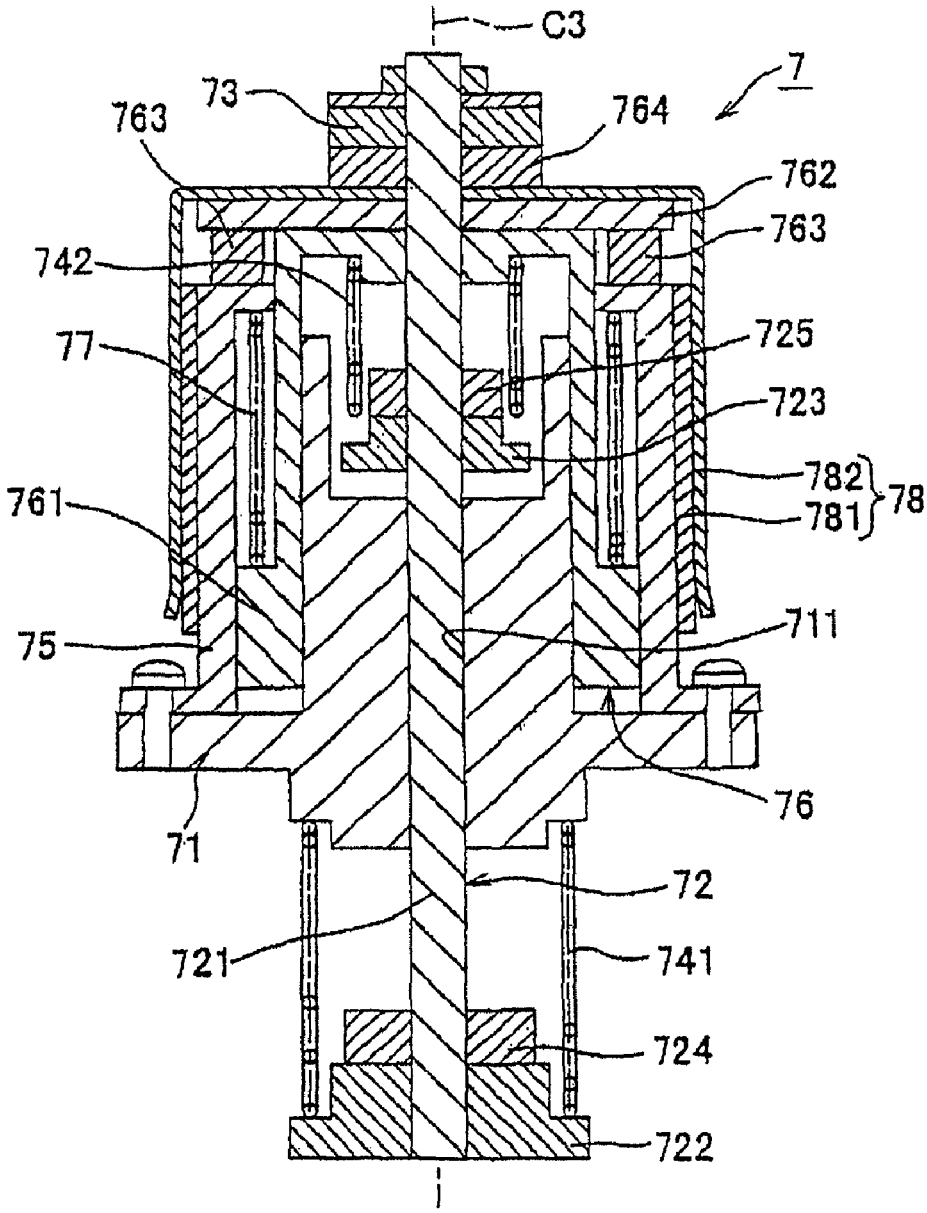
FIG. 7 is a sectional side view of a reaction force exerting unit according to a third embodiment of the present invention.
Figure 8:
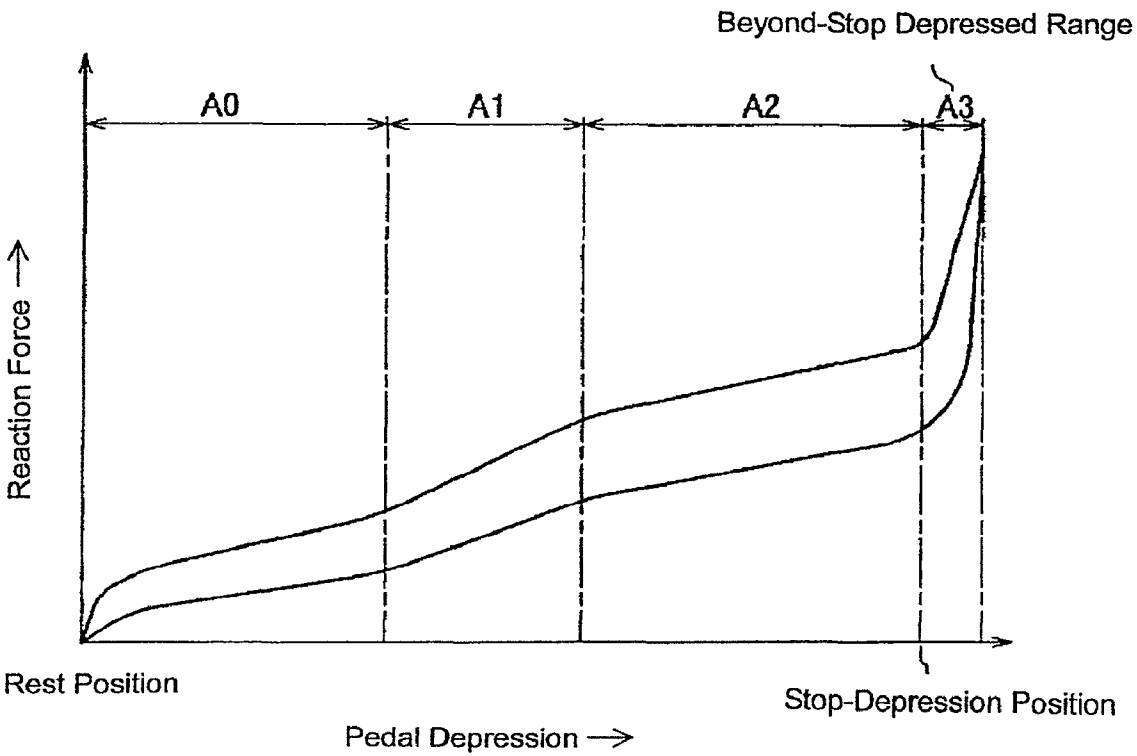
FIG. 8 is a graphical representation of the reaction force exerted on the pedal by the reaction force exerting unit shown in FIG. 7 as a function of the amount of the depression of the pedal lever.

Referring now to FIGS. 7 and 8, a description will be made about a third embodiment of a pedal device of an electronic keyboard musical instrument according to the present invention. In FIG. 7, like parts as those in the pedal device 1 of the first embodiment shown in FIGS. 1-2*b* are given like references to indicate the correspondencies and detailed description of some of them will be omitted for the sake of simplicity. Although, in the first embodiment described above, the upper first spring 742 as the first urging member 74 is abutting the flange piece 723 of the first movable member 72 in the rest (initial) position, urging the first movable member 72 toward the direction to exert a reaction force on the pedal lever 2 from the beginning of the depression stroke, the present invention may not necessarily be limited to such a configuration. For example, as shown in FIG. 7, the upper first spring 742 may be provided to be spaced apart from the flange piece 723 of the first movable member 72 in the initial position as seen in FIG. 7, so that the upper first spring 742 is to abut against the first movable member 7 after the pedal lever 2 has been depressed by a certain amount. According to such a configuration, only the lower first spring 741 urges the first movable member 72 within the range A0 of FIG. 8 before the upper first spring 742 abuts against the first movable member 72, and both the lower and upper first springs 741, 742 urges the first movable member 72 within the range A1 of FIG. 8 after the upper first spring 742 abuts against the first movable member 72 and before the first movable member 72 starts to push up the second movable member 76. In the third embodiment, therefore, the lower first spring 741 contributes to the increase rate of the reaction force exerted on the pedal lever 2 throughout the regions A0-A3 of FIG. 8. The upper first spring 742 contributes to the increase rate of the reaction force exerted on the pedal lever 2 only in the range A1 of FIG. 8. The second spring 77 contributes to the increase rate of the reaction force exerted on the pedal lever 2 in the ranges A2 and A3. Consequently the increase rate of the reaction force in the range A1 can be designed to be greater than the increase rate of the reaction force in the range A0, which will be advantageous in simulating different feelings of pedal manipulations on different models of acoustic pianos from various manufacturers. While the lower and upper first springs 741, 742 and the second springs 77 are so arranged that the increase rate of the reaction force in the range A2 is smaller than the increase rate of the reaction force, not only in the range A1 (among the range A01) contiguous to the range A2, but in the entire range of A01 in the case of the first embodiment, the lower and upper first springs 741, 742 and the second spring 77 can be so arranged that the increase rate of the reaction force in the range A2 is smaller than the increase rate of the reaction force only in the range A1.

In the first through third embodiments described above, the first movable member 72 and the second movable member 76 are disposed around the common axis C3 at the same axial position to overlap with each other in the axial direction, with the first movable member 72 locating inside the second movable member 76, however the arrangement may not necessarily be limited to such a configuration. For example, the second movable member 76 may be positioned inside the first movable member 72. In other words, the first and second movable members 72 and 76 can be arranged at an axial position with respect to the common axis C3 to overlap with each other in the axial direction, with one of the first and second movable members 72 and 76 being arrange at an inner position and the other being arranged at an outer position.

Further in the first embodiment described above, the first spring 742 and the second spring 77 are disposed around the common axis C3 at the same axial position to overlap with each other in the axial direction, with the first spring 742 locating inside the second spring 77, however the arrangement may not necessarily be limited to such a configuration. For example, the first spring 741 and the second spring 77 can be arranged at an axial position with respect to the common axis C3 to overlap with each other in the axial direction, with the first spring 741 locating inside the second spring 77. Further the two first springs 741 and 742 may be arrange at an axial position with respect to the common axis C3 to overlap with each other in the axial direction, with one of the first springs 741 and 742 being arranged at an inner position and the other being arranged at an outer position. In other words, among a plurality of springs constituting the first urging member and the second urging member, two of the springs can be arranged at an axial position with respect to the common axis C3 to overlap with each other in the axial direction, with the one locating inside and the other locating outside.

Further in the first embodiment described above, the first springs 741, 742 and the second spring 77 are so arranged that the increase rate of the reaction force in the range A2 after the first movable member 72 has started to push up the second movable member 76 is smaller than the increase rate of the reaction force in the range A01 before the first movable member 72 starts to push up the second movable member 76, however, the present invention may not necessarily be limited to such a configuration. For example, the first springs 741, 742 and the second spring 77 may be so designed and configured that the increase rate of the reaction force in the range A2 after the first movable member 72 has started to push up the second movable member 76 is greater than the increase rate of the reaction force in the range A01 before the first movable member 72 starts to push up the second movable member 76. Further, while the first embodiment employs two first springs 741, 742 as the first urging member 74 to urge the first movable member 72, the first urging member 74 may consist of the first spring 741 only provided between the first fixed member 71 and the first movable member 72.

While several preferred embodiments have been described and illustrated in detail herein above with reference to the drawings, it should be understood that the illustrated embodiments are just for preferable examples, that the present invention may not necessarily be limited to the illustrated embodiments, and that the present invention can be practiced with various modifications, improvements and combinations without departing from the spirit of the present invention.

What is claimed is:

1. A pedal device of an electronic keyboard musical instrument, the pedal device comprising:

a pedal lever swingable on a fulcrum within a stroke range between an initial position and an end position according to a depressing manipulation by a player of the instrument; and a reaction force exerting unit for exerting on the pedal lever a reaction force of an amount which depends on an amount of swing of the pedal lever, the reaction force exerting unit comprising as an integral unit;

a first movable member to be displaced according to the swing of the pedal lever as the swing of the pedal lever is transferred from the pedal lever to the first movable member directly or by means of a transferring member;

a first urging member which urges the first movable member in a direction to exert the reaction force on the pedal lever;

a second movable member to be displaced according to the displacement of the first movable member after the amount of the swing of the pedal lever exceeds a predetermined amount; and a second urging member which urges the second movable member in the direction to exert the reaction force on the pedal lever, wherein the first movable member, the second movable member, the first urging member and the second urging member are arranged coaxially with each other with respect to a common axis in a configuration that the first movable member and the second movable member are capable of thrusting along the common axis, wherein the first movable member, the second movable member, the first urging member and the second urging member are arranged relative to each other such that the reaction force exerted on the pedal lever increases in accordance with the amount of the swing of the pedal lever at a first rate of increase of the reaction force per amount of the swing in a first stroke range of the swing in which only the first movable member is being displaced in response to the swing of the pedal lever, while the reaction force exerted on the pedal lever increases in accordance with the amount of the swing of the pedal lever at a second rate of increase of the reaction force per amount of the swing in a second stroke range of the swing in which both of the first movable member and the second movable member are being displaced in response to the swing of the pedal lever, wherein the second rate of increase at a part of the second stroke range contiguous to the first stroke range is smaller than the first rate of increase in the first stroke range.

2. A pedal device as claimed in claim 1, wherein the first urging member and/or the second urging member are constituted by a plurality of urging members, two of the plurality of urging members being arranged such that one of the two is positioned inside the other of the two overlapping each other at a same axial position.

3. A pedal device as claimed in claim 1, further comprising:

a friction mechanism integrally arranged with the reaction force exerting unit to cause a friction force resisting the displacement of the first movable member according to the swing of the pedal lever.

4. A pedal device as claimed in claim 1, further comprising a detecting mechanism integrally arranged with the reaction force exerting unit to detect the movement of the first movable member according to the swing of the pedal lever throughout the stroke range of the swing from the initial position to the end position.

* * * * *